US011384539B2

(12) United States Patent
Genest et al.

(10) Patent No.: US 11,384,539 B2
(45) Date of Patent: Jul. 12, 2022

(54) MASONRY BLOCK SYSTEM

(71) Applicants: Christopher R. Genest, Sanford, ME (US); Matthew M. Genest, Sanford, ME (US)

(72) Inventors: Christopher R. Genest, Sanford, ME (US); Matthew M. Genest, Sanford, ME (US)

( * ) Notice: Subject to any disclaimer, the term of this patent is extended or adjusted under 35 U.S.C. 154(b) by 0 days.

(21) Appl. No.: 17/145,509

(22) Filed: Jan. 11, 2021

(65) Prior Publication Data

US 2021/0214941 A1 Jul. 15, 2021

Related U.S. Application Data

(60) Provisional application No. 62/958,753, filed on Jan. 9, 2020.

(51) Int. Cl.
*E04C 1/39* (2006.01)

(52) U.S. Cl.
CPC ..... *E04C 1/39* (2013.01)

(58) Field of Classification Search
CPC ... E04C 1/39; E04C 1/397; E04C 1/40; E04C 2/26; E04C 2/288; E04C 1/41; E04C 1/00; E04C 2/044; E04C 3/34; E04C 2/04; E04B 2/54; E04B 2/18; E04B 2/08; E04B 2/52; E04B 2002/0206; E04B 2/42; E04B 2/14; E04B 2/16; E04B 2/20; E04B 2/44
USPC ..... 52/590.2, 596, 593, 604, 605, 606, 607, 52/220.2, 405.1
See application file for complete search history.

(56) References Cited

U.S. PATENT DOCUMENTS 786,250 A * 3/1905 Dunham ..... E04B 2/42 52/605
1,305,294 A * 6/1919 McIntyre ..... E04B 2/14 52/607
1,385,299 A * 7/1921 Bilque ..... E04B 2/14 52/98
1,472,981 A * 11/1923 Johnstone ..... E04B 2/42 52/444
1,623,094 A * 4/1927 Cooley ..... E04B 2/42 52/605
1,652,305 A * 12/1927 Frewen ..... E04B 2/14 52/436
1,654,631 A * 1/1928 Bevier ..... E04B 2/02 52/302.4
1,683,441 A * 9/1928 Bone ..... E04B 2/42 52/606
1,686,373 A * 10/1928 Foster ..... E04B 2/42 52/289
1,727,362 A * 9/1929 Bone ..... E04B 2/42 52/503
1,887,701 A * 11/1932 Stevens ..... E04B 2/14 52/125.3
1,969,879 A * 8/1934 Eichner ..... E04C 1/39 52/351
1,980,982 A * 11/1934 Crawford ..... E04C 1/39 52/351
2,114,244 A * 4/1938 Zoettl ..... E04B 2/02 52/441

(Continued)

*Primary Examiner* — Brian E Glessner
*Assistant Examiner* — Adam G Barlow

(57) ABSTRACT

A masonry block that is particularly well suited for the construction of narrow walls, such as interior building walls, that is adapted to receive conventional utilities and reinforcing supports.

8 Claims, 6 Drawing Sheets

(56) References Cited

U.S. PATENT DOCUMENTS 2,319,203 A * 5/1943 Branham ..... E04B 2/20 D25/117
2,951,318 A * 9/1960 Sedlak ..... E04B 2/52 52/100
3,256,657 A * 6/1966 Phipps ..... E04B 2/16 52/436
3,292,331 A * 12/1966 Sams ..... E04B 2/10 52/439
D220,622 S * 5/1971 Passander ..... D25/118
3,609,926 A * 10/1971 Muse ..... E04B 2/44 52/439
3,855,752 A * 12/1974 Aylon ..... E04B 2/52 52/439
3,908,324 A * 9/1975 Stout ..... E04B 5/48 52/607
3,968,615 A * 7/1976 Ivany ..... E04B 2/8629 52/592.1
4,319,440 A * 3/1982 Rassias ..... E04B 2/52 52/607
4,426,815 A * 1/1984 Brown ..... A63H 33/088 D25/115
4,640,071 A * 2/1987 Haener ..... E04B 2/52 52/592.1
4,670,204 A * 6/1987 Cruise ..... B28B 11/042 264/72
D319,109 S * 8/1991 Bimber ..... D25/118
6,050,044 A * 4/2000 McIntosh ..... A63H 33/082 446/124
6,189,282 B1 * 2/2001 VanderWerf ..... E04B 2/14 52/582.1
6,453,625 B1 * 9/2002 Corbett ..... E04C 1/41 52/125.3
6,513,293 B2 * 2/2003 Miller ..... E04C 1/397 52/503
6,665,994 B1 * 12/2003 Rugged ..... E04B 2/14 52/603
6,681,542 B2 * 1/2004 Pribyl ..... E04F 11/022 52/607
8,677,715 B2 * 3/2014 Giorio ..... E04C 1/397 52/603
9,863,145 B2 * 1/2018 Genest ..... E04C 1/39
D860,478 S * 9/2019 Dominique ..... D25/113
10,526,783 B2 * 1/2020 Hon ..... E04C 1/00
2001/0022057 A1 * 9/2001 Miller ..... E04C 1/397 52/309.12
2002/0187010 A1 * 12/2002 MacDonald ..... E02D 29/025 405/286
2006/0117699 A1 * 6/2006 Di Trapani ..... E04G 21/16 52/604
2008/0148676 A1 * 6/2008 Azar ..... E04B 2/16 52/604
2010/0132298 A1 * 6/2010 Rodebaugh ..... E02D 29/025 52/603
2013/0276400 A1 * 10/2013 Genest ..... E04B 2/52 52/600
2014/0223848 A1 * 8/2014 Binhussain ..... E04B 2/18 52/604
2014/0373459 A1 * 12/2014 Newsome ..... E04B 1/04 52/98
2015/0308698 A1 * 10/2015 Weber ..... F24D 3/145 52/173.1
2016/0160468 A1 * 6/2016 Rossi ..... E02D 29/0241 52/604
2017/0145690 A1 * 5/2017 Genest ..... E04C 1/41
2018/0044914 A1 * 2/2018 Martinez ..... E04B 2/08

* cited by examiner

MASONRY BLOCK SYSTEM

FIELD OF THE INVENTION

The invention relates to masonry blocks, and in particular blocks that are used in creating building structures.

DISCUSSION OF PRIOR ART

Masonry blocks are frequently used for, among other things, building walls of residential and commercial structures, and in particular exterior walls that largely support the entire building structure. In a conventional masonry block wall, the blocks are laid on bond, that is, one block covers one half of two blocks below it, so that the vertical joint formed by adjacent blocks in one row does not align with a vertical joint similarly formed in a previous row. Such blocks typically have one or more chambers to allow for the insertion of utilities, insulation, and reinforcing steel bars. Thick layers of mortar are used to seal the connection between one row of blocks the row of blocks above/beneath it.

In the United States, for example, the typical block is 16 inches in length and 8 inches in width. The cores of the blocks are typically tapered so that the top surface has a greater area on which to spread a mortar bed. It is common for the blocks to have two cores that allow for the insertion of steel reinforcement that spans courses in order to increase tensile strength so that the wall of blocks has sufficient strength. In short, this is a large and sturdy block that is generally configured to support the exterior of a building.

However, masonry blocks may be used for other forms of walls as well, for example, interior building walls, outdoor kitchens, and landscaping wall. In many situations such as these, such a large and sturdy block is not only unnecessary but in many ways unwanted. For example, interior walls generally need to be narrower so as to not take up too much interior space while still being strong and also allowing for utility installations such as electrical wiring and plumbing. The conventional 16×8 inch blocks, which work well for these outer walls, are often too large and cumbersome to serve as inner walls.

What is needed, therefore, is a block that is comparatively narrow but that still has the strength to stand as a building structure. What is further needed a block design that allows for the installation of utility features that are common while also enabling the convenient installation of such utility features.

BRIEF SUMMARY OF THE INVENTION

The invention is masonry block that is narrow, relative to the conventional 16 inch by 8 inch block, having at least two small chambers for the installation of utility features such as electrical outlets and at least one large chamber for installation of reinforcing members and/or insulation. The narrow masonry block is adapted to be particularly advantageous for construction of the inner walls of buildings such as residential homes as well as with a number of other wall structures such as landscaping walls and outdoor kitchens.

The narrow masonry block has an approximately rectangular shape with two wall faces and two end faces that are closed to bound the chambers and top and bottom faces that open around the chambers. The closed wall faces and end faces include score lines that indicate areas where the blocks may be broken to allow reinforcing supports and/or allow access to the chambers for the inclusion of external items such as the aforementioned electrical outlets.

For example, a score line may be vertically oriented near a midpoint of each of the at least two small chambers. This illustrates to an installer where the block may be broken in order to open the side of the inner chamber and allow for the insertion of an electrical outlet.

A channel may be positioned on the top face between the two narrow chambers to allow reinforcing supports such as rebar to be laid at the top of the block. Additionally, the end face, and particularly the end face that closes the large chamber, has score lines near a top portion along with knockout cuts to weaken that portion of the block so as to allow users to break a select area that is in line with the channel so as to allow the reinforcing supports to run across the entire block and, when used to form a wall, allow the supports to run along a row of the wall.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

Figure 1A:
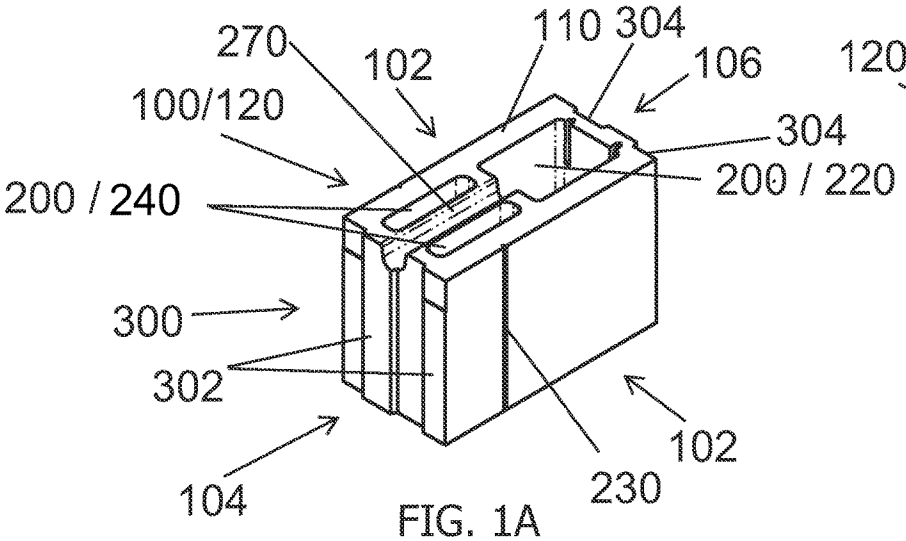
FIG. 1A is a perspective view of the full block according to the invention, showing the front, top, and right side.

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

The invention is a masonry block 100 for building masonry block walls and that is constructed to receive reinforcing materials and utility devices. The utilities include the conventional types of electrical outlets, wires, cables and piping that are common in most building structures. The common reinforcing means are reinforcing bars or "rebar". The block 100 may be used in the construction of any number of types of buildings and walls, but it is particularly advantageous when used in the construction of an interior building wall.

The term "masonry block" 100 is a general term for the block according to the invention and includes a stretcher block 120 and a half block 140 that fit together to form a wall. Incorporated into each block 100 is at least one chamber 200 for receiving, among other things, reinforcing bars, as well as a connector means 300 for mating adjacent blocks with each other.

The general shape of the blocks 100 is square or rectangular, with the outer perimeter having one or more indentations and/or protrusions on one or more of the faces of the particular block. Each block has two wall faces 102 that form opposite sides of the block and are the faces of the block that are visible on the two faces of a wall, and each block has a first end face 104 and a second end face 106, a top face 110, and a bottom face 112. Elements that are functionally identical in the various blocks 120 and 140 retain the same reference designation.

Figure 1B:
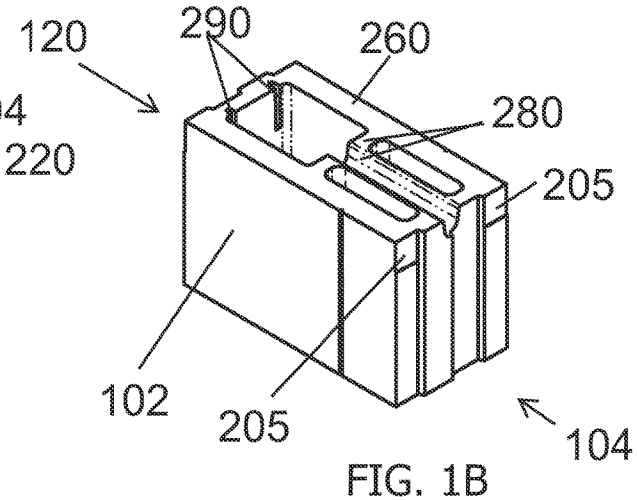
FIG. 1B is a perspective view showing the front, top, and left side.
Figure 1C:
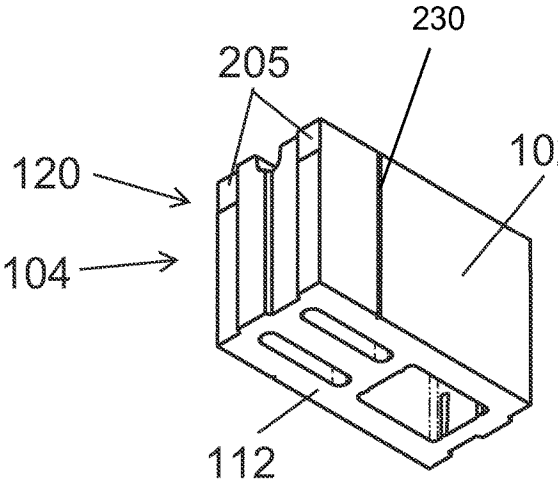
FIG. 1C is a perspective view showing the front, bottom, and right side.
Figure 1D:
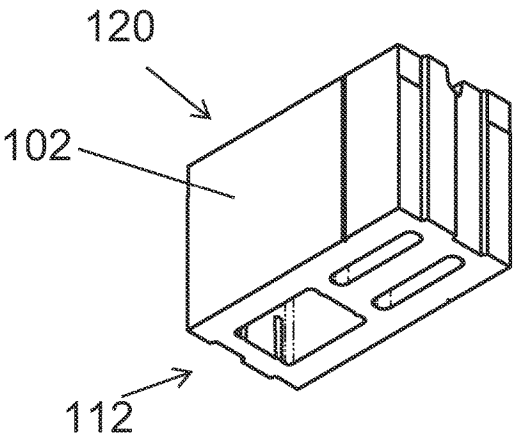
FIG. 1D is a perspective view showing the front, bottom, and left side.
Figure 1F:
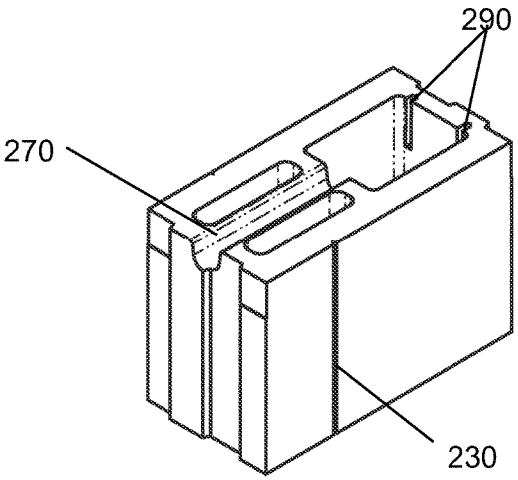
FIG. 1F is a perspective view of the block.
Figure 1H:
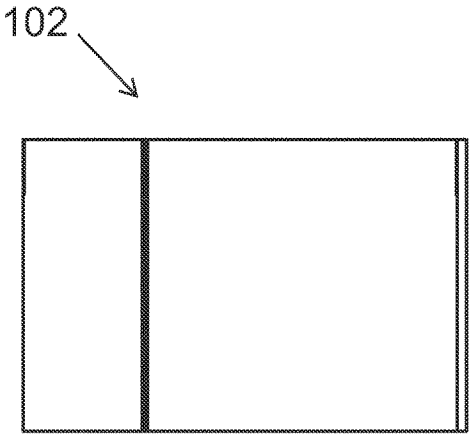
FIG. 1H is a side view of the block.
Figure 1E:
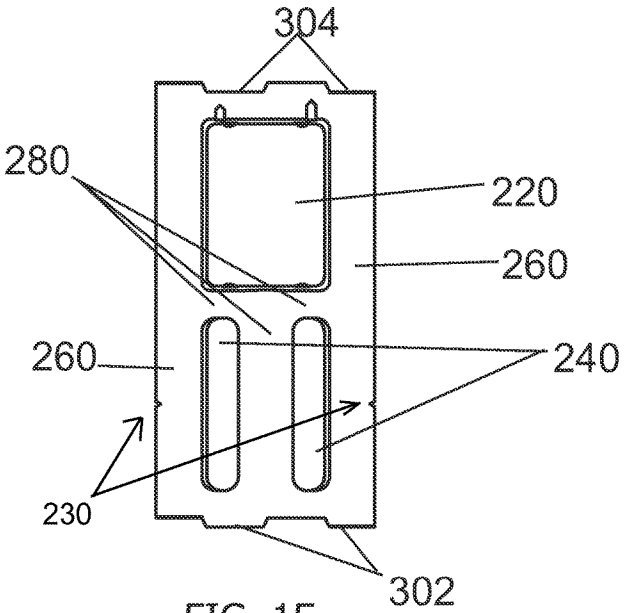
FIG. 1E is a top view of the block.
Figure 1G:
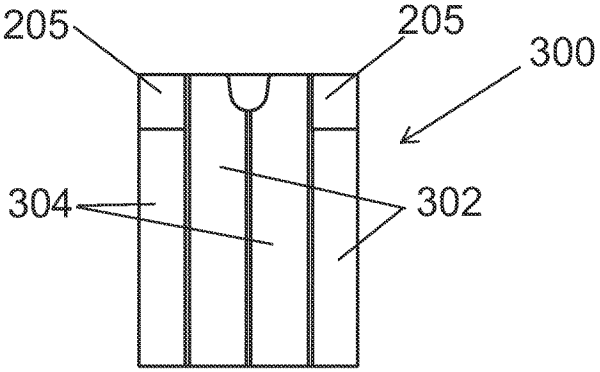
FIG. 1G is a front end view of the block.

FIGS. 1A-H illustrate the stretcher block 120. The wall faces 102 are mirror-reverse images of each other and, thus, one reference designation shall be used to indicate one or both of the wall faces. The connector means 300 on the stretcher block includes a male connector 302 and female connector 304 on each end face 104, 106. When two stretcher blocks 120 are assembled adjacent to one another on a row, the male connector 302 on the first end face 104 mates with the female connector 304 on the second end face 106 of the adjacent block.

The stretcher block 120 includes a plurality of chambers 200. More particularly, the block 120 includes one large chamber 220 and two narrow or small chambers 240, the chambers being bounded by an outer web 260 and separated by an inner web 280. The large chamber 220 is ideal for the insertion of reinforcing members such as rebar. The small chambers 240 are particularly well suited for utilities such as electrical wiring and electrical outlet boxes. The wall faces 102, 104, that are adjacent to, or that bound, the small chamber 240 may be cut away, after which electrical boxes may be inserted in the opened narrow chamber 240 in such a manner that the outer edge of the electrical box is flush with an inside wall of a building.

A u-shaped channel 270 is provided on the top of the stretcher blocks 120 between the small chambers 240, and two small knockout cuts 290 are made on the end of the large chamber 220. As the small chambers 240 are generally used for utilities and as such it may not be possible to fill them with reinforcing materials such as grout and rebar. The cuts 290 are scores which cause that part of the block to be a weaker relative to the other parts of the block in order to allow that part out of the block to be knocked away such that rebar may be laid horizontally through the channel 270 and the knocked out space between the cuts 290.

Long score marks 230 are provided on the wall faces to indicate location of the narrow chambers 220. In general, these score marks indicate a location that is at or near the center of the narrow chamber and inform a builder where to break or cut the block in order to access the chamber in order to insert utilities.

The stretcher block 120 may be constructed in any suitable size, however, a block that is roughly six inches in width, eight inches in height, and twelve inches in length is particularly useful for constructing a strong inner wall with space for utilities and reinforcing supports. In this example, the large chambers 220 may be approximately 4.7 inches in length and 4 inches in width while the small chambers 240 may be approximately 4.7 inches in length and 1 inch in width. This size block is also well suited for the installation of a conventional electrical box, which typically has a depth of 2⅛ inches or 2¼ inches. These measurements are merely examples of one suitable size for the block and are not limiting, for example, while the design is advantageous for narrow blocks, such as those that are less than 8 inches in width, it is suitable for any block measuring at least 6 inches in width.

Figure 2A:
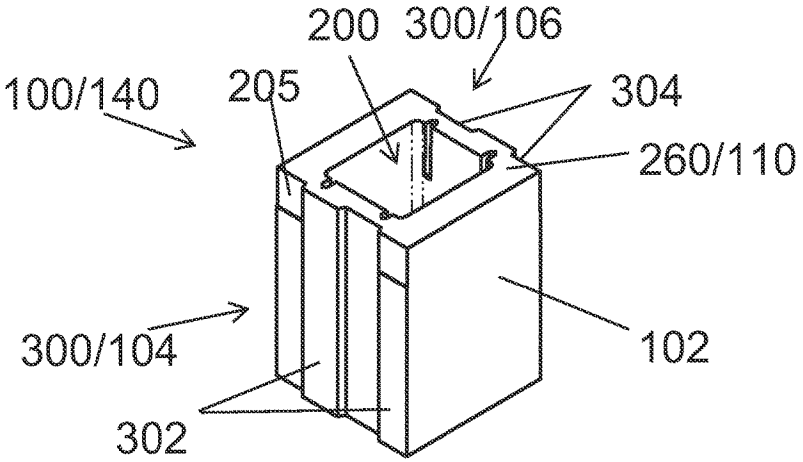
FIG. 2A is a perspective view of the half block according to the invention, showing the front, top, and right side.
Figure 2B:
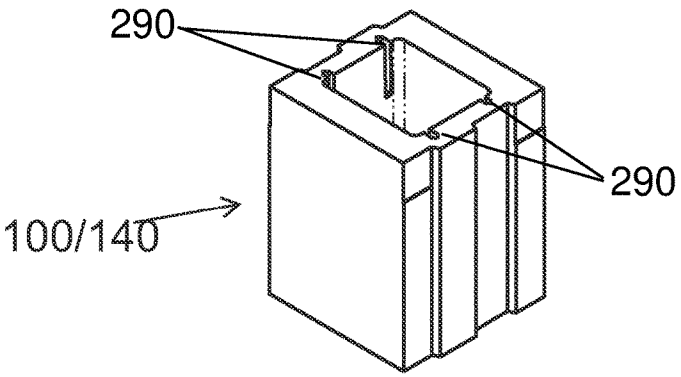
FIG. 2B is a perspective view showing the front, top, and left side.
Figure 2C:
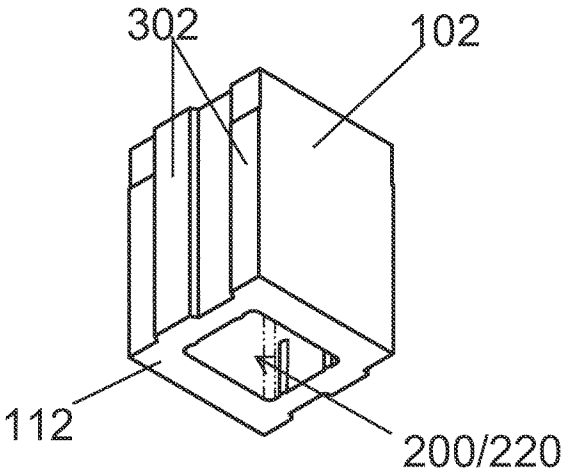
FIG. 2C is a perspective view showing the front, bottom, and right side.
Figure 2D:
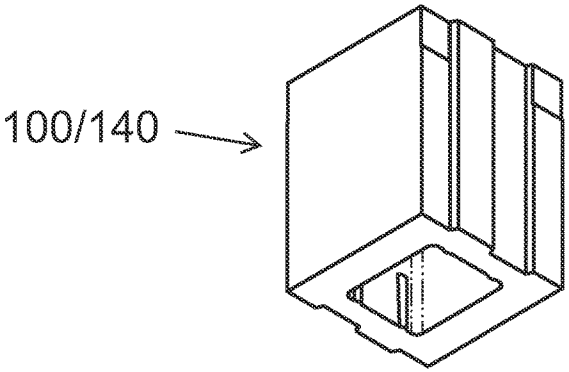
FIG. 2D is a perspective view showing the front, bottom, and left side.
Figure 2F:
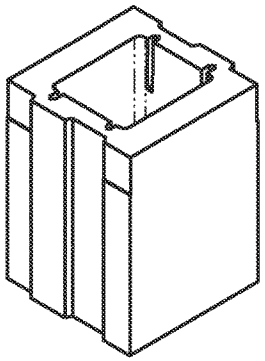
FIG. 2F is a perspective view of the block.
Figure 2H:
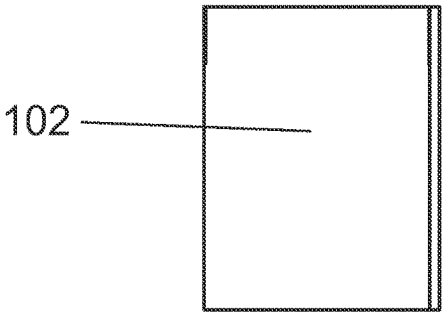
FIG. 2H is a side view of the block.
Figure 2E:
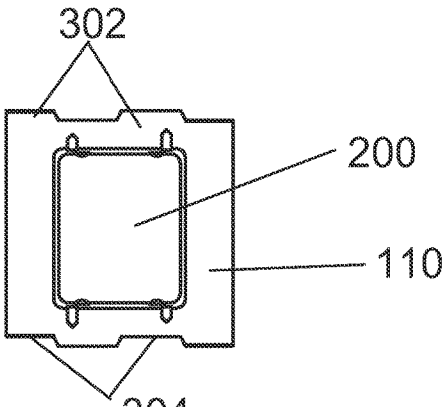
FIG. 2E is a top view of the block.
Figure 2G:
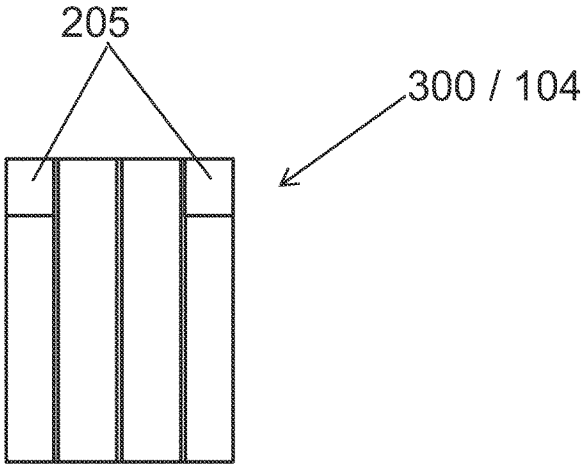
FIG. 2G is a front end view of the block.

FIGS. 2A-2H illustrate the half block 140. This block is often used as an end block, in place of the full-size stretcher block 120, so that the blocks 100 may be laid on bond relative to the previously laid course of blocks 100. The construction of this half block 140 is very similar to that of the stretcher block 120, in that it has the wall faces 102, 104, recesses 220 and connectors. The difference being that it has only one chamber and is roughly half as long as the stretcher block.

Again, the block may be of any size, but is generally intended to have a length that is approximately half the length of the stretcher block 120 while having the same or similar height and width. When constructed for use with a stretcher block of the previous example, the half block is likely to be roughly six inches in width, eight inches in height, and six inches in length.

Two small cuts 290 are made on the end of the chamber 220. Again, as with the stretcher block the cuts 290 cause this portion of the block to be weaker relative to the other parts of the block in order to allow that part out of the block to be knocked away such that rebar may be laid horizontally through the top of the block 140.

Small notches 205 are provided in the upper corner of each face 104, 106 of the block 100, which allow for the insertion of line pins (not shown). After a course of blocks 100 has been put in place, and/or during the laying of a course of blocks 100, a range line may be hooked to each pin to ensure the wall is kept straight.

Figure 3B:
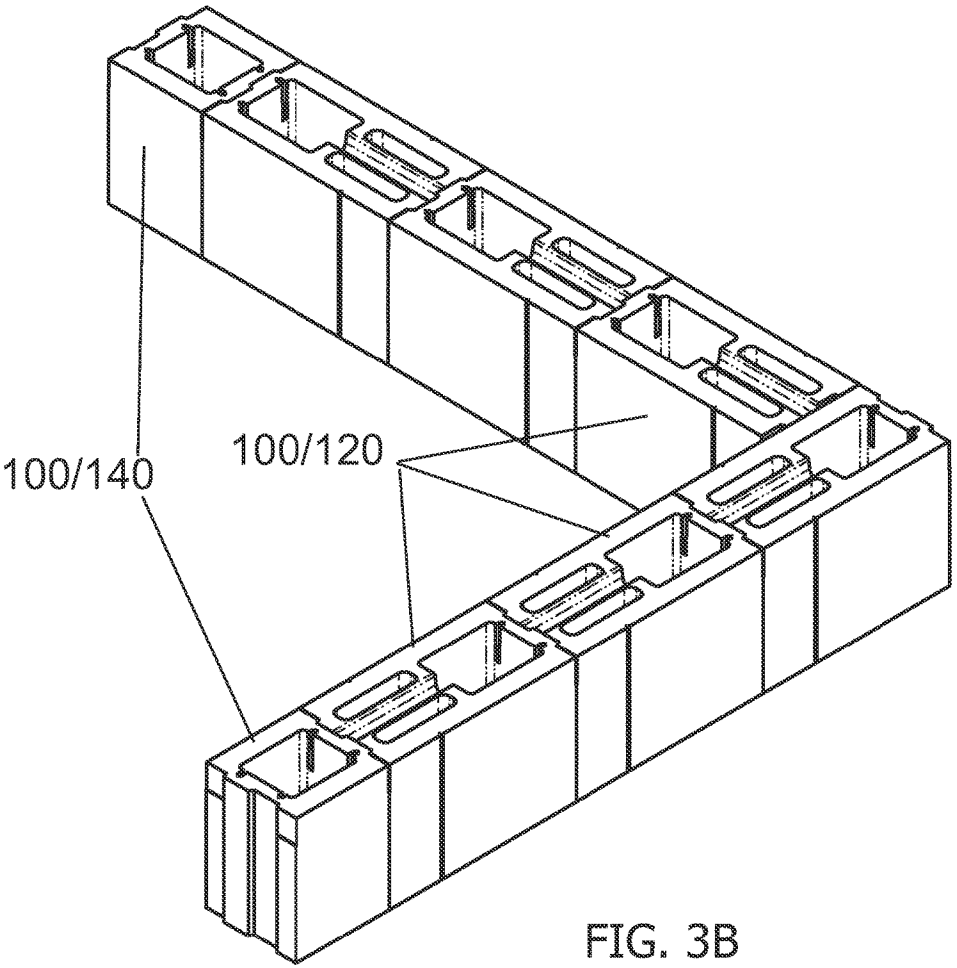
FIG. 3B is a perspective view of a partial wall.
Figure 3A:
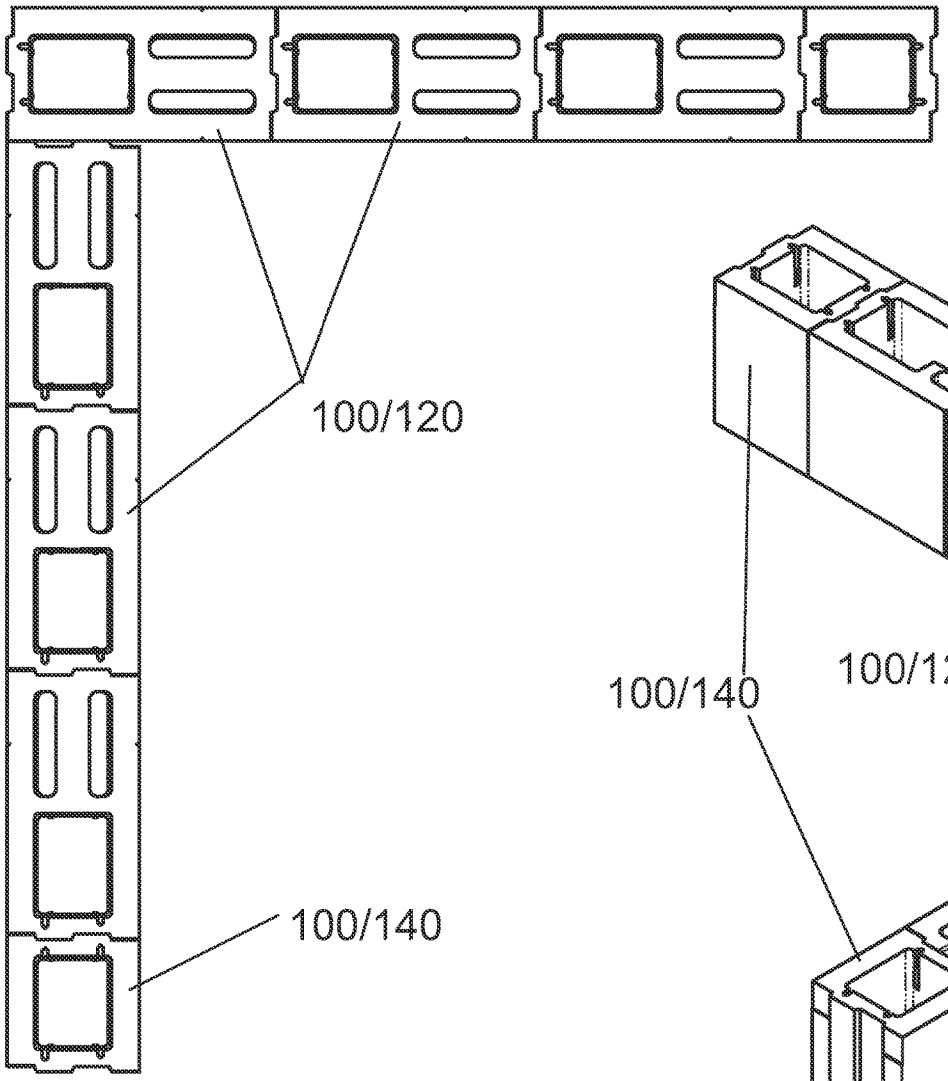
FIG. 3A is a top view of a partial wall built from a single course of blocks.
Figure 4B:
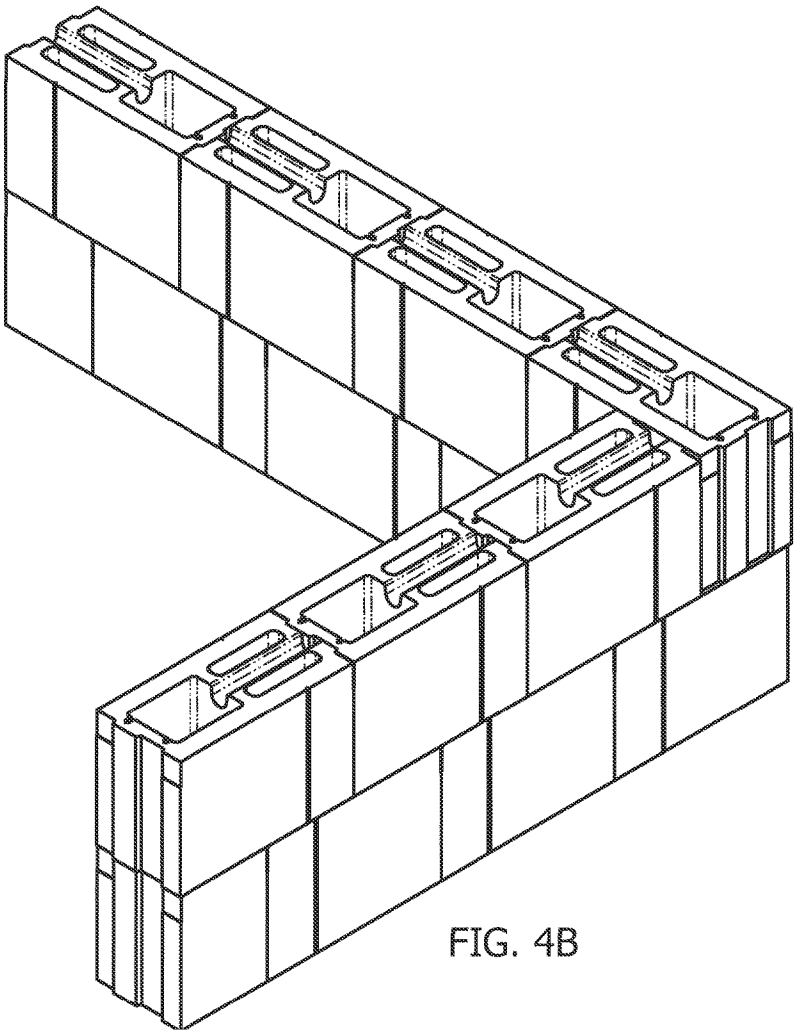
FIG. 4B is a perspective view of a partial wall.
Figure 4A:
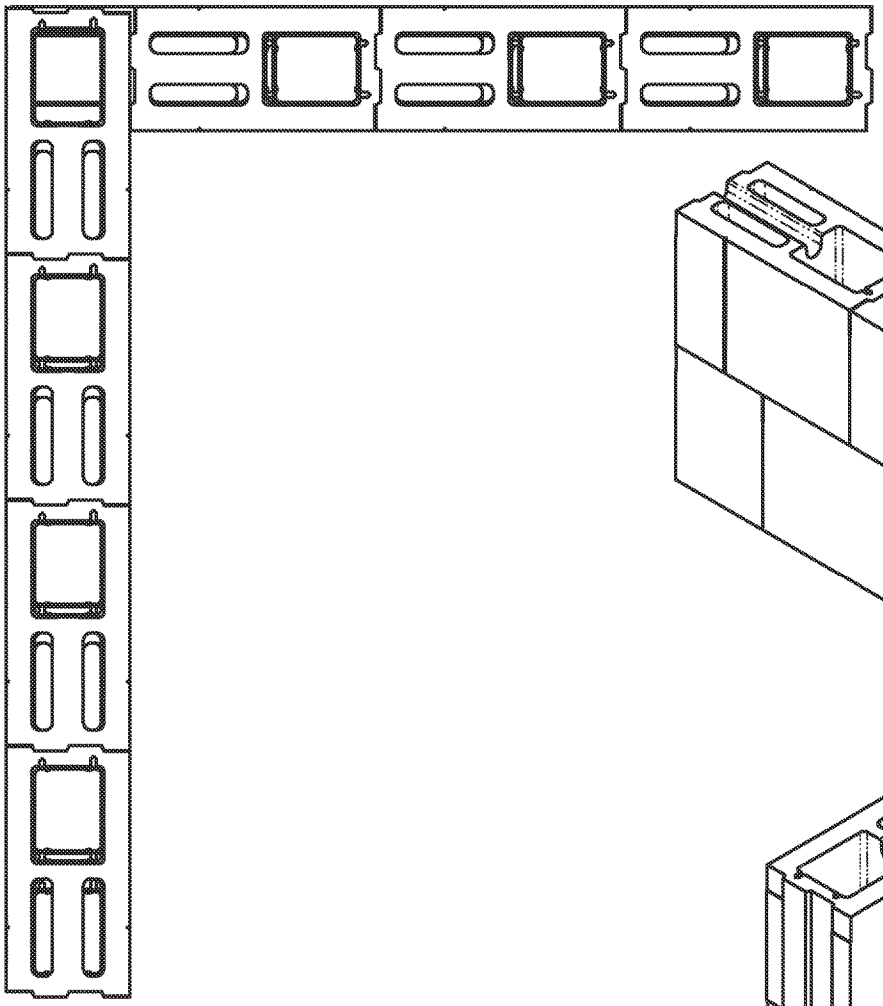
FIG. 4A is a top view of a partial wall built from multiple courses of the blocks.

FIGS. 3A and 3B and 4A and 4B illustrate a course of a wall constructed with the building blocks 100 according to the invention. Stretcher blocks 120 and/or half blocks 140 are interconnected with each other. In the embodiment shown, the wall includes a first wall and a second wall that extends at a 90-degree angle to the first wall. It is preferable if vertical rebar is placed every four feet and horizontal rebar is similarly placed every four feet It is understood that the embodiments described herein are merely illustrative of the present invention. Variations in the construction of the masonry may be contemplated by one skilled in the art without limiting the intended scope of the invention herein disclosed and as defined by the following claims.

What is claimed is:

1. A masonry block adapted for use in constructing a wall of masonry blocks, the masonry block comprising:

a block that is substantially rectangular having four sides, the four sides of the block including two wall faces and two end faces, the two wall faces being the faces of the block that are visible when a wall is constructed, and the two end faces including a first end face and a second end face on each end of the block;

each of the first end face and the second end face include a male connector and female connector that are adapted to mate with the male and female connectors of an adjacent block, the male connector and female connector being contiguous with one another on each end face;

a plurality of chambers within the block that are bounded by an outer web and separated by an inner web, the plurality if chambers including a large chamber and at least two small chambers, the large chamber positioned on one end of the block and bound on one end by the first end face, the at least two small chambers positioned on an end of the block that is opposite the large chamber and bound on one end by the second end face, the two small chambers further oriented in a manner that is approximately parallel to one another having approximately the same size and shape and being separated from one other by a single wall of the inner web.

2. The masonry block of claim 1, further including a channel positioned on top of the inner web between the at least two small chambers, the channel adapted to receive reinforcing supports.

3. The masonry block of claim 2, further including cuts in an end portion of the large chamber that are in line with the channel, the cuts adapted to weaken a portion of the block to enable the portion to be broken and allow the reinforcing supports to be positioned along an entirety a top portion of the block.

4. The masonry block of claim 1, wherein the outer faces include score lines that along at least one of the two small chambers, and whereas the score lines are adapted to indicate where the wall face may be broken to reveal the inner chamber; and wherein the inner chamber is adapted to receive an electrical box.

5. The masonry block of claim 4, wherein the score lines are approximately vertically oriented near a mid-point of each of the at least two small chambers.

6. The masonry block of claim 1, further comprising a notch in an upper corner of each end face for receiving a line pin.

7. The masonry block of claim 1, further comprising one or more chamber notches located inside one or more of the chambers.

8. The masonry block of claim 1, wherein the block has a width that is less than approximately 8 inches.

* * * * *